US008987947B2

(12) United States Patent
Higashiyama et al.

(10) Patent No.: US 8,987,947 B2
(45) Date of Patent: Mar. 24, 2015

(54) AIR CONDITIONER

(71) Applicant: Daikin Industries, Ltd., Osaka (JP)

(72) Inventors: Shin Higashiyama, Osaka (JP); Hiroshi Doumae, Osaka (JP); Shinya Ohtsuki, Osaka (JP); Masaki Okauchi, Osaka (JP)

(73) Assignee: Daikin Industries, Ltd., Osaka-Shi (JP)

( * ) Notice: Subject to any disclaimer, the term of this patent is extended or adjusted under 35 U.S.C. 154(b) by 0 days.

(21) Appl. No.: 14/369,358

(22) PCT Filed: Dec. 25, 2012

(86) PCT No.: PCT/JP2012/008225
§ 371 (c)(1),
(2) Date: Jun. 27, 2014

(87) PCT Pub. No.: WO2013/099199
PCT Pub. Date: Jul. 4, 2013

(65) Prior Publication Data

US 2015/0008762 A1 Jan. 8, 2015

(30) Foreign Application Priority Data

Dec. 28, 2011 (JP) ..... 2011-287103

(51) Int. Cl.
*H01H 47/00* (2006.01)
*F24F 11/02* (2006.01)
*F24F 11/00* (2006.01)

(52) U.S. Cl.
CPC ..... *F24F 11/02* (2013.01); *F24F 11/006* (2013.01); *F24F 2011/0075* (2013.01)
USPC ..... 307/113

(58) Field of Classification Search
USPC ..... 307/113
See application file for complete search history.

(56) References Cited

U.S. PATENT DOCUMENTS

2008/0092570 A1* 4/2008 Choi ..... 62/157

FOREIGN PATENT DOCUMENTS

| | | | |
|---|---|---|---|
| JP | 2000-111123 | A | 4/2000 |
| JP | 2010-54065 | A | 3/2010 |
| JP | 2010-78196 | A | 4/2010 |

* cited by examiner

*Primary Examiner* — Rexford Barnie
*Assistant Examiner* — Dru Parries
(74) *Attorney, Agent, or Firm* — Birch, Stewart, Kolasch & Birch, LLP

(57) ABSTRACT

An indoor unit of an air conditioner includes a relay K2R switched by an indoor control circuit between an on state in which the relay K2R connects signal and power lines and an off state in which the relay K2R disconnects the signal and power lines. An outdoor unit of the air conditioner includes a relay K13R switched by an outdoor control circuit between an on state in which the relay K13R connects the outdoor control circuit to the AC power supply and an off state in which the relay K13R connects the outdoor control circuit to the signal line. The relay K2R is switched to the on state with the relay K13R in the off state. When the outdoor control circuit is started, the relay K13R is switched to the on state, and then the relay K2R is switched to the off state, thereby starting the outdoor unit.

3 Claims, 7 Drawing Sheets

AIR CONDITIONER

TECHNICAL FIELD

The present invention relates to air conditioners, and particularly to reduction of standby power consumption of air conditioners.

BACKGROUND ART

In some type of air conditioners, an outdoor unit and an indoor unit are connected to each other by three lines: a power supply line, a signal line for signal transmission, and a common line shared by an alternating current (AC) transmission and signal transmission. Examples of such air conditioners include an air conditioner in which power supply to an outdoor unit control circuit is shut off during standby in order to reduce standby power consumption, as described in, for example, Patent Document 1.

Specifically, in the air conditioner of Patent Document 1, an outdoor unit includes an outdoor relay for opening/closing connection between an outdoor unit controller and a main power supply and a relay driver for driving the outdoor relay, and an indoor unit includes a driving power supply for supplying driving power to the relay driver and an indoor relay for opening/closing connection between the driving power supply and the relay driver. In a shift to a standby mode, the indoor relay is switched, thereby supplying driving power from the driving power supply to the relay driver through the signal line. Once the driving power has been supplied to the relay driver, the relay driver switches the outdoor relay to sever the connection between the main power supply and an indoor unit controller. In this manner, power supply to the indoor unit controller is shut off.

CITATION LIST

Patent Document

[Patent Document 1] Japanese Unexamined Patent Publication No. 2010-54065

SUMMARY OF THE INVENTION

Technical Problem

In the air conditioner as described above, however, since power has been supplied from the driving power supply to the relay driver during standby, standby power consumption of the outdoor unit, and thus the whole system, cannot be sufficiently reduced.

It is therefore an object of the present invention to achieve sufficient reduction of standby power consumption of an air conditioner.

Solution to the Problem

A first aspect of the present invention is directed to an air conditioner in which a power line (L) for transmission of AC power from an AC power supply (40), a signal line (S) for signal transmission, and a common line (N) to be shared by the transmission of AC power and the signal transmission are connected to one another between an outdoor unit (10) and an indoor unit (20). The indoor unit (20) includes an indoor control circuit (23) and a first switch (K2R) that is switched by the indoor control circuit (23) between an on state in which the first switch (K2R) connects the signal line (S) and the power line (L) to each other and an off state in which the first switch (K2R) disconnects the signal line (S) and the power line (L) from each other. The outdoor unit (10) includes an outdoor control circuit (13) and a second switch (K13R) that is switched by the outdoor control circuit (13) between an on state in which the second switch (K13R) connects the outdoor control circuit (13) to the AC power supply (40) and an off state in which the second switch (K13R) connects the outdoor control circuit (13) to the signal line (S).

In the first aspect, when the first switch (K2R) is switched to the on state with the second switch (K13R) being in the off state, power is supplied from the AC power supply (40) to the outdoor control circuit (13) through the signal line (S). In this manner, the outdoor control circuit (13) is started, and the second switch (K13R) is switched to the on state, thereby supplying power from the AC power supply (40) to the outdoor control circuit (13). In addition, when the first switch (K2R) and the second switch (K13R) are switched to the off state, power supply from the AC power supply (40) to the outdoor control circuit (13) is shut off.

In a second aspect of the present invention, in the air conditioner of the first aspect, the indoor control circuit (23) switches the first switch (K2R) to the on state with the second switch (K13R) being in the off state, and when the outdoor control circuit (13) starts, the outdoor control circuit (13) switches the second switch (K13R) to the on state, then the indoor control circuit (23) switches the first switch (K2R) to the off state, and starts the outdoor unit (10).

In the second aspect, in starting the outdoor unit (10), the first switch (K2R) is first switched to the on state with the second switch (K13R) being in the off state. This switching causes power to be supplied from the AC power supply (40) to the outdoor control circuit (13) through the signal line (S), thereby starting the outdoor control circuit (13). Then, the second switch (K13R) is switched to the on state, and then the first switch (K2R) is switched to the off state, thereby starting the outdoor unit (10).

In a third aspect of the present invention, in the air conditioner of the second aspect, the indoor unit (20) includes an indoor unit transmission circuit (21), the outdoor unit (10) includes an outdoor unit transmission circuit (11) that performs signal transmission with the indoor unit transmission circuit (21) through the signal line (S), and a third switch (K14R) that switches between an on state in which the third switch (K14R) connects the outdoor unit transmission circuit (11) and the signal line (S) to each other and an off state in which the third switch (K14R) disconnects the outdoor unit transmission circuit (11) and the signal line (S) from each other, and in starting the outdoor unit (10), the outdoor control circuit (13) switches the third switch (K14R) to the on state after the first switch (K2R) has been switched to the off state.

In the third aspect, in starting the outdoor unit (10), the first switch (K2R) is switched to the off state, and then the third switch (K14R) is switched to the on state. This switching can inhibit an AC flowing from the AC power supply (40) to the outdoor unit transmission circuit (11) through the signal line (S).

In a fourth aspect of the present invention, in the air conditioner of the third aspect, in starting the outdoor unit (10), the outdoor control circuit (13) switches the third switch (K14R) to the on state after a lapse of a predetermined time from switching of the first switch (K2R) to the off state.

In the fourth aspect, in starting the outdoor unit (10), the third switch (K14R) is switched to the on state after a lapse of a sufficient time from switching of the first switch (K2R) to the off state. This switching can ensure inhibition of a flow of an AC to the outdoor unit transmission circuit (11).

Advantages of the Invention

As described above, according to the present invention, the outdoor control circuit (13) is started by switching the first switch (K2R) to the on state, and then power is supplied from the AC power supply (40) to the outdoor control circuit (13) by switching the second switch (K13R) to the on state. In this manner, the outdoor unit (10) is started. Then, the power supply from the AC power supply (40) to the outdoor control circuit (13) is shut off by switching the first switch (K2R) and the second switch (K13R) to the off state. In this manner, standby power consumption of the outdoor unit (10) can be sufficiently reduced.

In the second aspect, the second switch (K13R) is switched to the on state after the first switch (K2R) has been switched to the on state. This switching ensures supply of power from the AC power supply (40) to the outdoor control circuit (13) through the signal line (S), thereby starting the outdoor control circuit (13). Thereafter, power is supplied from the AC power supply (40) to the outdoor control circuit (13). Subsequently, the first switch (K2R) is switched to the off state, thereby inhibiting a current flowing from the AC power supply (40) to the signal line (S). In this manner, the outdoor unit (10) can be started without fail.

In the third aspect, the third switch (K14R) is switched to the on state after the first switch (K2R) has been switched to the off state, thereby inhibiting an AC flowing from the AC power supply (40) to the outdoor unit transmission circuit (11) through the signal line (S). In this manner, the outdoor unit transmission circuit (11) can be protected at the start of the outdoor unit (10).

In the fourth aspect, the third switch (K14R) is switched to the on state after a lapse of a predetermined time from switching of the first switch (K2R) to the off state. This switching ensures protection of the outdoor unit transmission circuit (11) at the start of the outdoor unit (10).

DESCRIPTION OF EMBODIMENTS

An embodiment of the present invention will be described in detail with reference to the drawings. Note that the following description of the preferred embodiment is merely illustrative in nature, and is not intended to limit the scope, applications, and use of the invention.

<Overall Configuration>

Figure 1:
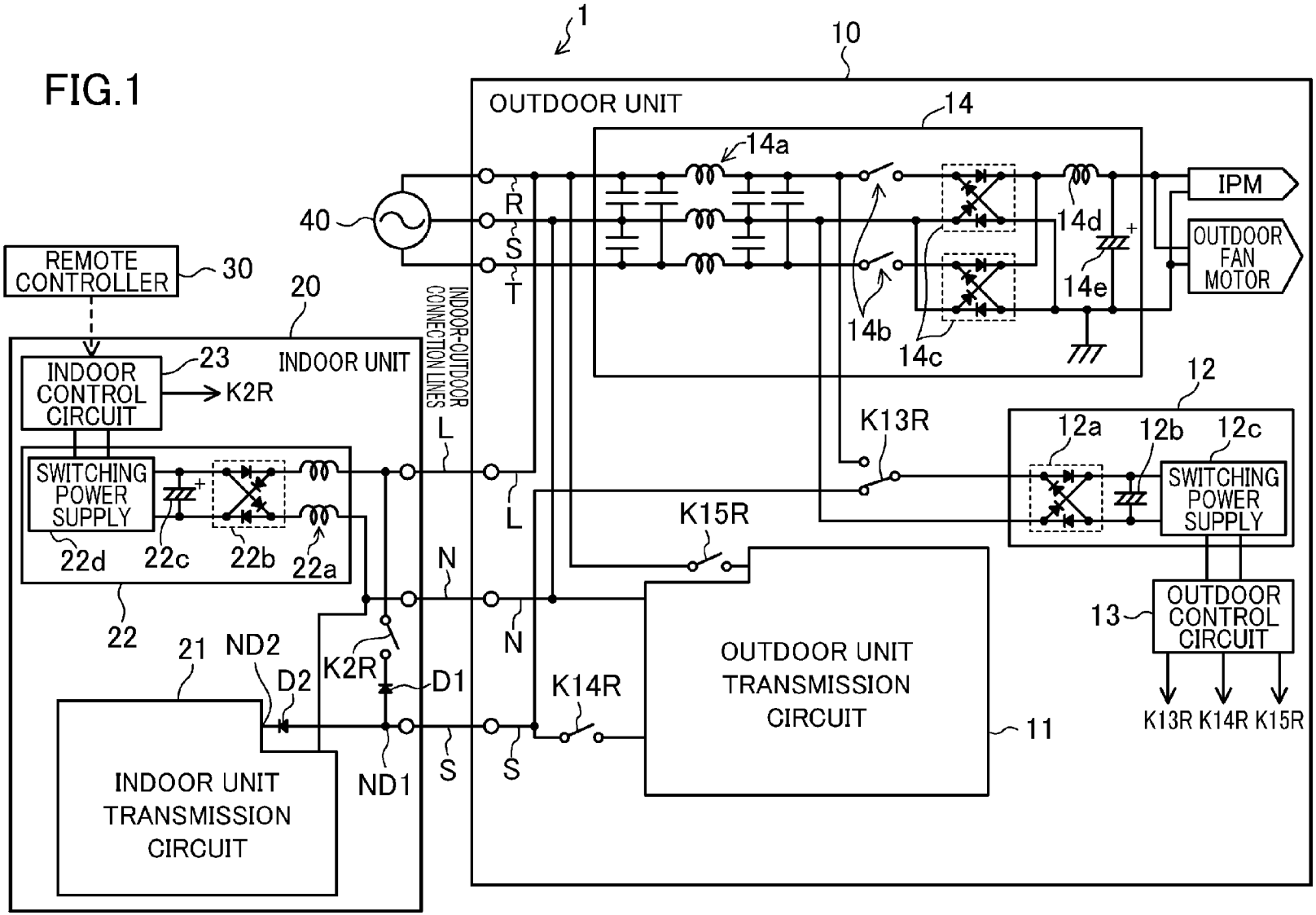
FIG. 1 is a block diagram illustrating an electrical system of an air conditioner according to an embodiment.

FIG. 1 is a block diagram illustrating an electrical system of an air conditioner (1) according to an embodiment of the present invention. As illustrated in FIG. 1, the air conditioner (1) includes an outdoor unit (10), an indoor unit (20), and a remote controller (30). Although not shown, the outdoor unit (10) includes an electric compressor, an outdoor heat exchanger, an outdoor fan, and an expansion valve, for example. The indoor unit (20) includes an indoor heat exchanger and an indoor fan, for example. In the air conditioner (1), these components constitute a refrigerant circuit (not shown) that performs a refrigeration cycle.

In the air conditioner (1), the outdoor unit (10) receives an AC (a three-phase AC at 200 V in this example) from a commercial AC power supply (40) and uses the AC as electric power for circuits and the electric compressor in the outdoor unit (10). The outdoor unit (10) also supplies part of the three-phase AC corresponding to two phases to the indoor unit (20). Signal communication is performed between the outdoor unit (10) and the indoor unit (20) in order to control the outdoor unit (10) from the indoor unit (20). For this purpose, the air conditioner (1) includes, between the outdoor unit (10) and the indoor unit (20), three lines (indoor-outdoor communication lines): a power line (L) for transmitting AC power from the AC power supply (40), a signal line (S) for transmitting the signal, and a common line (N) to be shared by the transmission of the AC power and transmission of the signal.

In this example, the power line (L) is connected to an R-phase of the AC power supply (40) in the outdoor unit (10), and the common line (N) is connected to an S-phase of the AC power supply (40) in the outdoor unit (10). That is, the indoor unit (20) is connected to the R-phase and the S-phase of the AC power supply (40) to supply a single-phase AC. The signal line (S) is used for transmission of AC power, which will be described later, in addition to the signal transmission. For this purpose, the signal line (S) employs a wiring material having a current carrying capacity suitable for grid power. In this embodiment, the wiring material used for the signal line (S) is the same as those used for the power line (L) and the common line (N).

<Outdoor Unit (10)>

The outdoor unit (10), serving as an electrical system, includes a first outdoor power supply circuit (14), a second outdoor power supply circuit (12), an outdoor unit transmission circuit (11), an outdoor control circuit (13), and relays (K13R, K14R, K15R).

—First Outdoor Power Supply Circuit (14)—

The first outdoor power supply circuit (14) converts a three-phase AC received from the AC power supply (40) to a direct current (DC), and supplies the DC to a so-called intelligent power module (indicated as IPM in the drawings) and an outdoor fan motor. The intelligent power module converts the input DC to an AC having a predetermined frequency and a predetermined voltage, and supplies the AC to the motor of the electric compressor. In this example, the first outdoor power supply circuit (14) includes a noise filter (14*a*), two main relays (14*b*), two diode bridge circuits (14*c*), a reactor (14*d*), and a smoothing capacitor (14*e*).

The noise filter (14*a*) includes a capacitor and a coil. The two main relays (14*b*) are respectively provided on the supply lines of the R-phase and T-phase of the three-phase AC. The main relays (14*b*) are so-called A-contact relays. Specifically, each of the main relays (14*b*) includes one fixed contact and one movable contact, and when power is supplied to the coil of the main relay (14*b*), these contacts are connected to each other (i.e., turned on). One of the two diode bridge circuits (14*c*) receives the R-phase and the S-phase of the three-phase AC, the other receives the S-phase and the T-phase of the three-phase AC, and each of the received phase of the AC is subjected to full-wave rectification. Outputs of the diode bridge circuits (14*c*) are input to the smoothing capacitor (14*e*) through the reactor (14*d*), and smoothed by the smoothing capacitor (14*e*). The DC smoothed by the smoothing capacitor (14*e*) is supplied to the intelligent power module and the outdoor fan motor.

—Second Outdoor Power Supply Circuit (12)—

The second outdoor power supply circuit (12) converts the two phases of the R-phase and S-phase of the three-phase AC to a DC (5 V in this example), and supplies the DC to the outdoor control circuit (13). In this example, the second outdoor power supply circuit (12) includes a diode bridge circuit (12*a*), a smoothing capacitor (12*b*), and a switching power supply (12*c*). One of the inputs of the diode bridge circuit (12*a*) is connected to the relay (K13R), which will be specifically described later, and the other input of the diode bridge circuit (12*a*) is connected to the S-phase of the three-phase AC. An output of the diode bridge circuit (12*a*) is smoothed by the smoothing capacitor (12*b*), and then input to the switching power supply (12*c*). The switching power supply (12*c*) is, for example, a DC-to-DC converter, and converts an input DC to a predetermined voltage (5 V), and outputs the voltage to the outdoor control circuit (13).

—Outdoor Unit Transmission Circuit (11)—

The outdoor unit transmission circuit (11) performs signal communication with the indoor unit transmission circuit (21). In this communication, based on a potential difference between the signal line (S) and the common line (N), communication of a binary digital signal of a high level and a low level is performed. An end of a communication circuit (not shown) in the indoor unit transmission circuit (21) is connected to the common line (N), and the other end of the communication circuit is connected to the signal line (S) through the relay (K14R).

—Relay (K13R)—

The relay (K13R) is a relay for switching an AC supply path to the second outdoor power supply circuit (12), and constitutes a second switch according to the present invention. The relay (K13R) is a so-called C-contact relay. Specifically, the relay (K13R) includes two fixed contacts and one movable contact, and when no electric power is supplied to the coil of relay (K13R) (i.e., in an off state), one of the fixed contacts (hereinafter referred to as a normally closed contact) is connected to the movable contact, whereas when electric power is supplied to the coil (i.e., in an on state), the other fixed contact (hereinafter referred to as a normally opened contact) is connected to the movable contact. Switching of the relay (K13R) (whether electric power is supplied to the coil or not) is controlled by the outdoor control circuit (13).

In this example, the movable contact of the relay (K13R) is connected to the input of the diode bridge circuit (12*a*). The normally closed contact is connected to the signal line (S), and the normally opened contact is connected to the R-phase of the three-phase AC. That is, when no electric power is supplied to the coil of the relay (K13R), the normally closed contact and the movable contact are connected to each other, and one of the inputs of the diode bridge circuit (12*a*) is connected to the signal line (S). Once electric power has been supplied to the coil of the relay (K13R), the movable contact and the normally opened contact are connected to each other, and an AC is input to the diode bridge circuit (12*a*) of the second outdoor power supply circuit (12). That is, the relay (K13R) is switched between an on state in which the relay (K13R) connects the outdoor control circuit (13) to the AC power supply (40) and an off state in which the relay (K13R) connects the outdoor control circuit (13) to the signal line (S).

—Relay (K14R)—

The relay (K14R) is a relay for switching the connection between the signal line (S) and the outdoor unit transmission circuit (11) between connection and disconnection, and constitutes a third switch according to the present invention. The relay (K14R) is a so-called A-contact relay, and when electric power is supplied to the coil of the relay (K14R), the connection between the fixed contact and the movable contact are turned on. That is, the relay (K14R) switches between an on state in which the relay (K14R) connects the outdoor unit transmission circuit (11) to the signal line (S) and an off state in which the relay (K14R) disconnects the outdoor unit transmission circuit (11) from the signal line (S). On/off operation of the relay (K14R) is controlled by the outdoor control circuit (13). In this example, the movable contact of the relay (K14R) is connected to the signal line (S), and the fixed contact of the relay (K14R) is connected to an end of a communication circuit (not shown) in the outdoor unit transmission circuit (11). Of course, in the A-contact relay, the correspondence between, for example, a signal to be input and each contact may be reversed.

—Relay (K15R)—

The relay (K15R) is a relay for switching the supply of power to the outdoor unit transmission circuit (11) between on and off. The relay (K15R) is a so-called A-contact relay. One of the contacts of the relay (K15R) is connected to a power supply node of the outdoor unit transmission circuit (11), and the other contact is connected to the R-phase of the three-phase AC. When the relay (K15R) is turned on, power is supplied to the outdoor unit transmission circuit (11), whereas when the relay (K15R) is turned off, power supply to the outdoor unit transmission circuit (11) is stopped. Turning on/off of the relay (K15R) is controlled by the outdoor control circuit (13).

—Outdoor Control Circuit (13)—

The outdoor control circuit (13) includes a microcomputer and a memory (not shown) storing a program for operating the microcomputer. In the outdoor control circuit (13), the outdoor unit transmission circuit (11), for example, controls the electric compressor and other components in response to a signal received from the indoor unit transmission circuit (21), and also controls start operation of the outdoor unit (10) (which will be specifically described later). When the air conditioner (1) is in a suspended state (which will be specifically described later), power supply to the outdoor control circuit (13) is shut off, and operation thereof is stopped.

<Indoor Unit (20)>

The indoor unit (20), serving as an electrical system, includes an indoor power supply circuit (22), an indoor unit transmission circuit (21), an indoor control circuit (23), a relay (K2R), a first diode (D1), and a second diode (D2).

—Indoor Power Supply Circuit (22)—

The indoor power supply circuit (22) includes a noise filter (22*a*), a diode bridge circuit (22*b*), a smoothing capacitor (22*c*), and a switching power supply (22*d*). The indoor power supply circuit (22) converts an AC supplied from the AC power supply (40) through the power line (L) and the common line (N) to a DC (a DC at 5 V in this example), and supplies the DC to the indoor control circuit (23).

In this example, the noise filter (22*a*) includes two coils. The diode bridge circuit (22*b*) performs full-wave rectification on an AC input from the power line (L) and the common line (N) through the noise filter (22*a*). The smoothing capacitor (22*c*) is, for example, an electrolytic capacitor, and smoothes an output of the diode bridge circuit (22*b*). The switching power supply (22*d*) is, for example, a DC-to-DC converter, converts the DC smoothed by the smoothing capacitor (22*c*) to a predetermined voltage (5 V), and inputs the predetermined voltage to the indoor control circuit (23).

—Indoor Unit Transmission Circuit (21)—

As described above, the indoor unit transmission circuit (21) performs signal communication with the outdoor unit transmission circuit (11). In this communication, communication of a digital signal is performed based on the potential difference between the signal line (S) and the common line (N). Thus, an end of a communication circuit of the indoor unit transmission circuit (21) is connected to the signal line (S) through the second diode (D2), and the other end of the communication circuit is connected to the common line (N).

—Relay (K2R) and First and Second Diodes (D1, D2)—

The relay (K2R) is a so-called A-contact relay, and constitutes a first switch according to the present invention. In this embodiment, the relay (K2R) and the first diode (D1) are provided in the indoor unit (20), and are serially connected to each other between the power line (L) and the signal line (S). More specifically, a movable contact of the relay (K2R) is connected to the power line (L), and a fixed contact of the relay (K2R) is connected to a cathode of the first diode (D1). The anode of the first diode (D1) is connected to the signal line (S).

The relay (K2R) serves as a switch for switching connection between the power line (L) and the signal line (S) between on and off That is, the relay (K2R) switches between an on state in which the relay (K2R) connects the signal line (S) and the power line (L) to each other and an off state in which the relay (K2R) disconnects the signal line (S) and the power line (L) from each other. On/off operation of the relay (K2R) is controlled by the indoor control circuit (23). The first diode (D1) inhibits an AC flowing into the indoor unit transmission circuit (21). The positional relationship between the first diode (D1) and the relay (K2R) may be reversed. Specifically, the positional relationship may be changed such that the cathode of the first diode (D1) is connected to the power line (L), the anode of the first diode (D1) is connected to one of the contacts of the relay (K2R), and the other contact of the relay (K2R) is connected to the signal line (S).

The anode of the second diode (D2) is connected to a connection node (ND1) between the first diode (D1) and the signal line (S), and the cathode thereof is connected to a signal input node (ND2) in the indoor unit transmission circuit (21). The second diode (D2) inhibits an AC flowing out of the indoor unit transmission circuit (21). In the air conditioner (1), since the common line (N) is connected to the S-phase of the AC power supply (40), the S-phase of the AC subjected to half-wave rectification in the second diode (D2) is superimposed on a communication signal between the indoor unit transmission circuit (21) and the outdoor unit transmission circuit (11). The first and second diodes (D1, D2) constitute an example of a protection circuit in this embodiment.

—Indoor Control Circuit (23)—

The indoor control circuit (23) includes a microcomputer and a memory (not shown) storing a program for operating the microcomputer. In response to a command from the remote controller (30), the indoor control circuit (23) controls an operating state (which will be described later) of the air conditioner (1). In order to receive a command from the remote controller (30), the indoor control circuit (23) is always supplied with power from the indoor power supply circuit (22).

<Remote Controller (30)>

The remote controller (30) accepts operation by a user, and transmits a signal in accordance with the operation of the user to the indoor control circuit (23). The user can perform operations such as operation start, operation stop, and set temperature adjustment of the air conditioner (1) by operating an operation button of the remote controller (30), for example. The remote controller (30) may be a so-called wired remote controller connected to the indoor control circuit (23) by a signal line or may be a so-called wireless remote controller that communicates with the indoor control circuit (23) by using an infrared ray or by electric wave.

<Operation of Air Conditioner>

Figure 2:
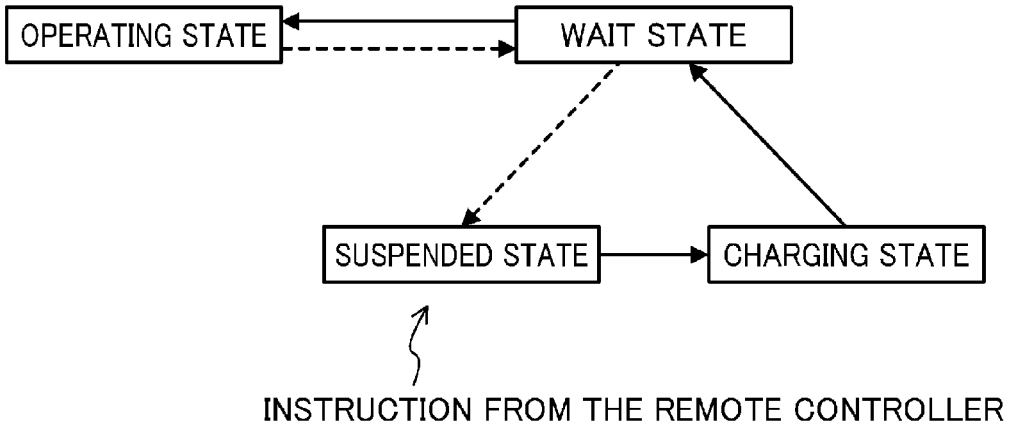
FIG. 2 is a state transition diagram of the air conditioner of the embodiment.

FIG. 2 is a state transition diagram of the air conditioner (1). The air conditioner (1) transitions among four states: a "suspended state," a "charging state," a "wait state," and an "operating state," which will be described later. In the following description, standby power consumption refers to "steady-state power consumption when equipment is not used or waits for some input (e.g., an instruction indication)". Specifically, in the air conditioner (1), power consumption necessary for only waiting for an instruction from the remote controller (30) is standby power consumption.

(1) Suspended State

The suspended state is a state in which electric power is supplied to the indoor unit (20) and no electric power is supplied to the outdoor unit (10).

The suspended state of this embodiment is, for example, a state in which power consumption of the whole air conditioner (1) is the minimum. Specifically, in the suspended state of this embodiment, the outdoor unit (10) receives and supplies power to the indoor unit (20), but no power is supplied to, for example, the circuits and the electric compressor in the outdoor unit (10). In this manner, in the suspended state, power supply to the circuits in the outdoor unit (10) is shut off, thereby reducing standby power consumption.

On the other hand, standby power consumption of the indoor unit (20) is the minimum, and part of the indoor control circuit (23) responsible for signal reception from the remote controller (30) receives electric power from the indoor power supply circuit (22) and operates. Standby power consumption of the remote controller (30) is also the minimum, and the remote controller (30) can accept predetermined indications such as a time stamp and a button operation by a user. The degrees of power consumption (standby power consumption) of the indoor unit (20) and the remote controller (30) are not limited to those described herein.

(2) Charging State

For the outdoor unit (10), the charging state refers to a state from formation of a circuit for charging the smoothing capacitor (12*b*) of the second outdoor power supply circuit (12) to start of signal transmission between the outdoor unit transmission circuit (11) and the indoor unit transmission circuit (21). Power consumption of the indoor unit (20) in the charging state is similar to that in the suspended state.

(3) Wait State

The wait state refers to a state after the charging state when operation is started, a state transitioned from an operating state (which will be described later) when operation is stopped. In both cases, the outdoor unit (10) is ready for, i.e., can promptly transition to, the operating state through the wait state. In the wait state, the outdoor unit transmission circuit (11) and the outdoor control circuit (13) can also operate. In particular, the wait state at an operation stop (i.e., the wait state transitioned from the operating state) is provided in order to uniformize the refrigerant pressure in the electric compressor and to be used for scheduled operation in which an operation start and an operation stop are repeatedly performed. The wait state is 10 minutes, for example. Power consumption of the indoor unit (20) is similar to that in the suspended state.

(4) Operating State

The operating state refers to a state in which the main relays (14*b*) are on and the electric compressor and the outdoor fan are operable or in operation. This state also refers to a so-called phase interruption and a thermo-off state. In the indoor unit (20), the indoor fan, for example, becomes an operating state, and power consumption is larger than those in the above-described states. The remote controller (30) is in an operation instruction state (e.g., a state in which operating states are displayed).

—State Transition in Air Conditioner (1)—

To start operation, the air conditioner (1) transitions from the suspended state to the operating state in the order indicated by the continuous-line arrows in FIG. 2. To stop operation, the air conditioner (1) transitions from the operating state to the suspended state in the order indicated by the broken-line arrows in FIG. 2. Example operations of the relays (K2R, K13R, K14R), the outdoor control circuit (13), and the transmission circuits (11, 21) in the transition from the suspended state to the operating state will be described with reference to FIGS. 3 to 7.

<Electrical System in Suspended State>

Figure 3:
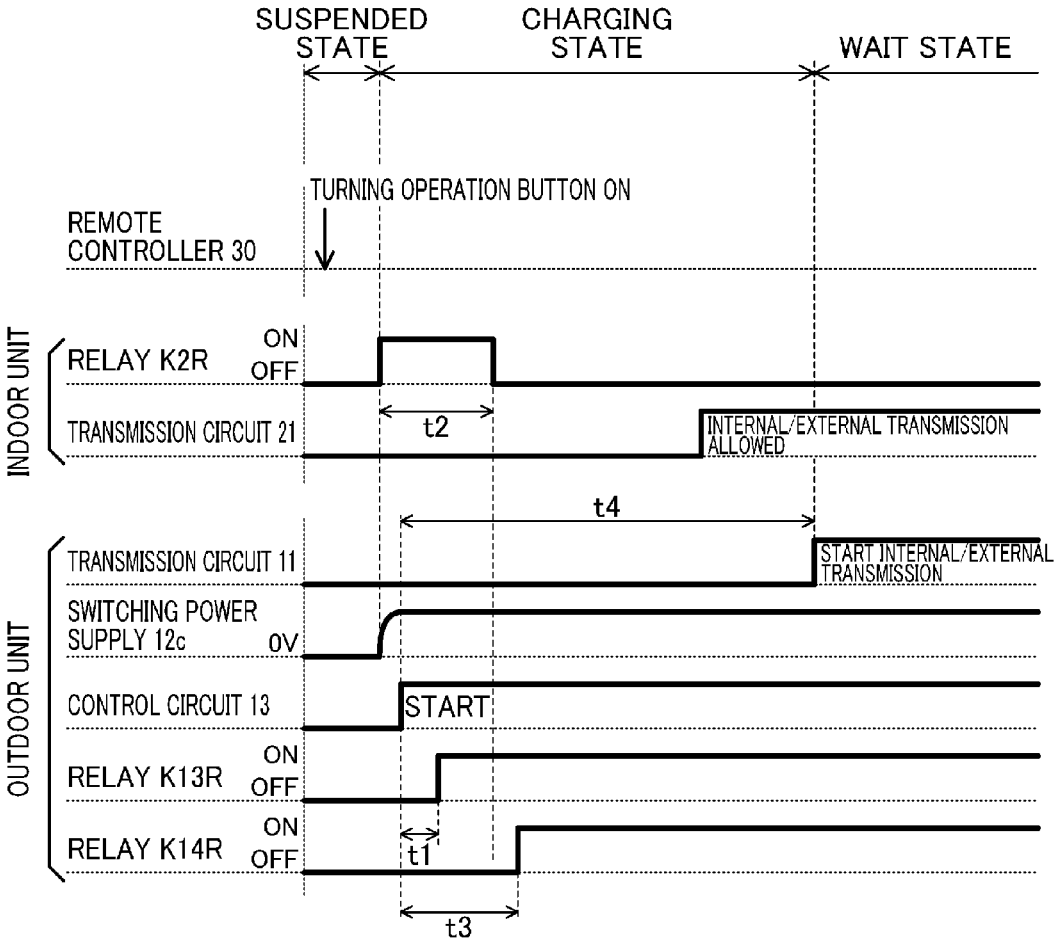
FIG. 3 is a time chart showing operations of relays in state transition.
Figure 4:
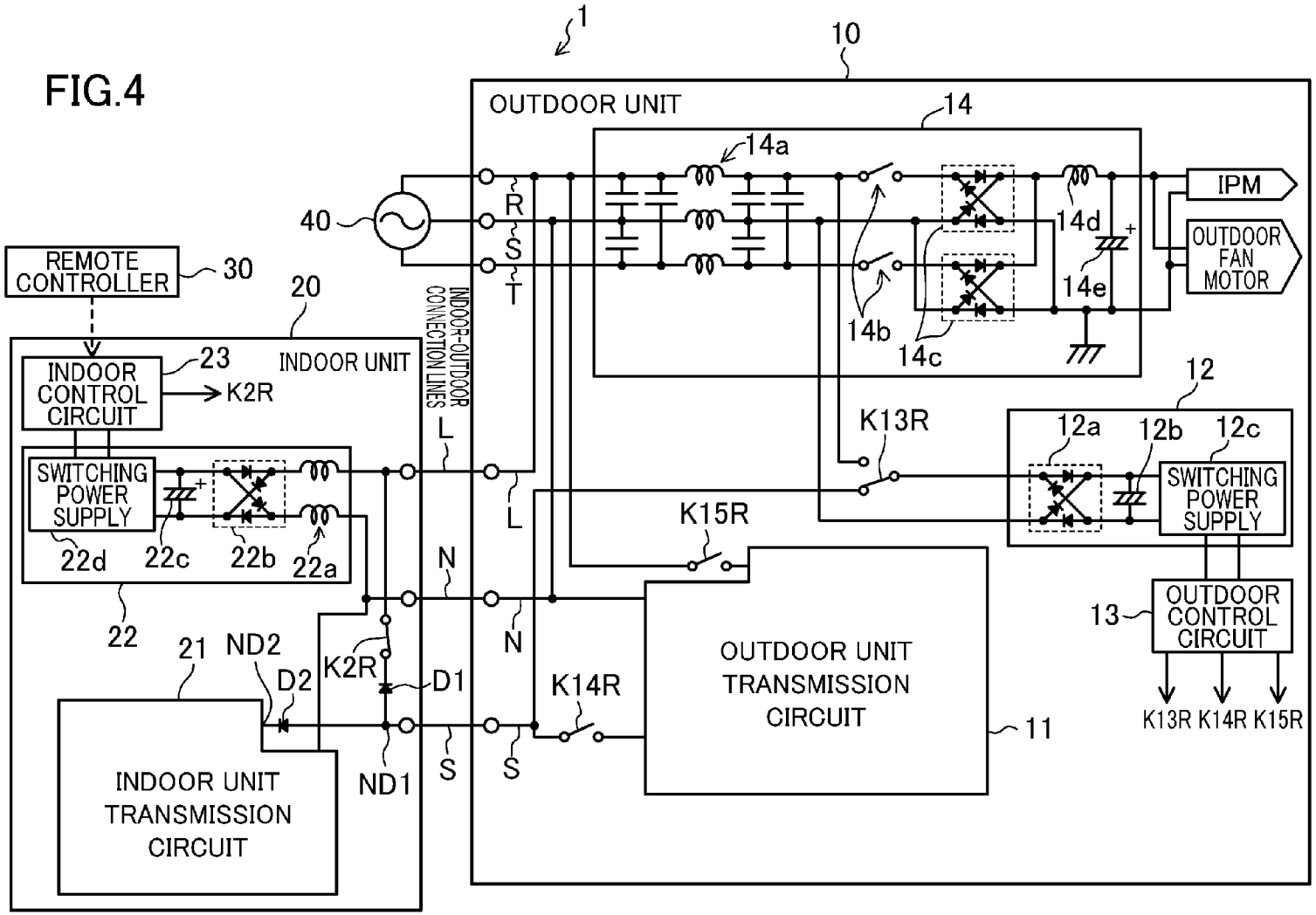
FIG. 4 illustrates states of the relays when a circuit for charging a smoothing capacitor is formed.
Figure 5:
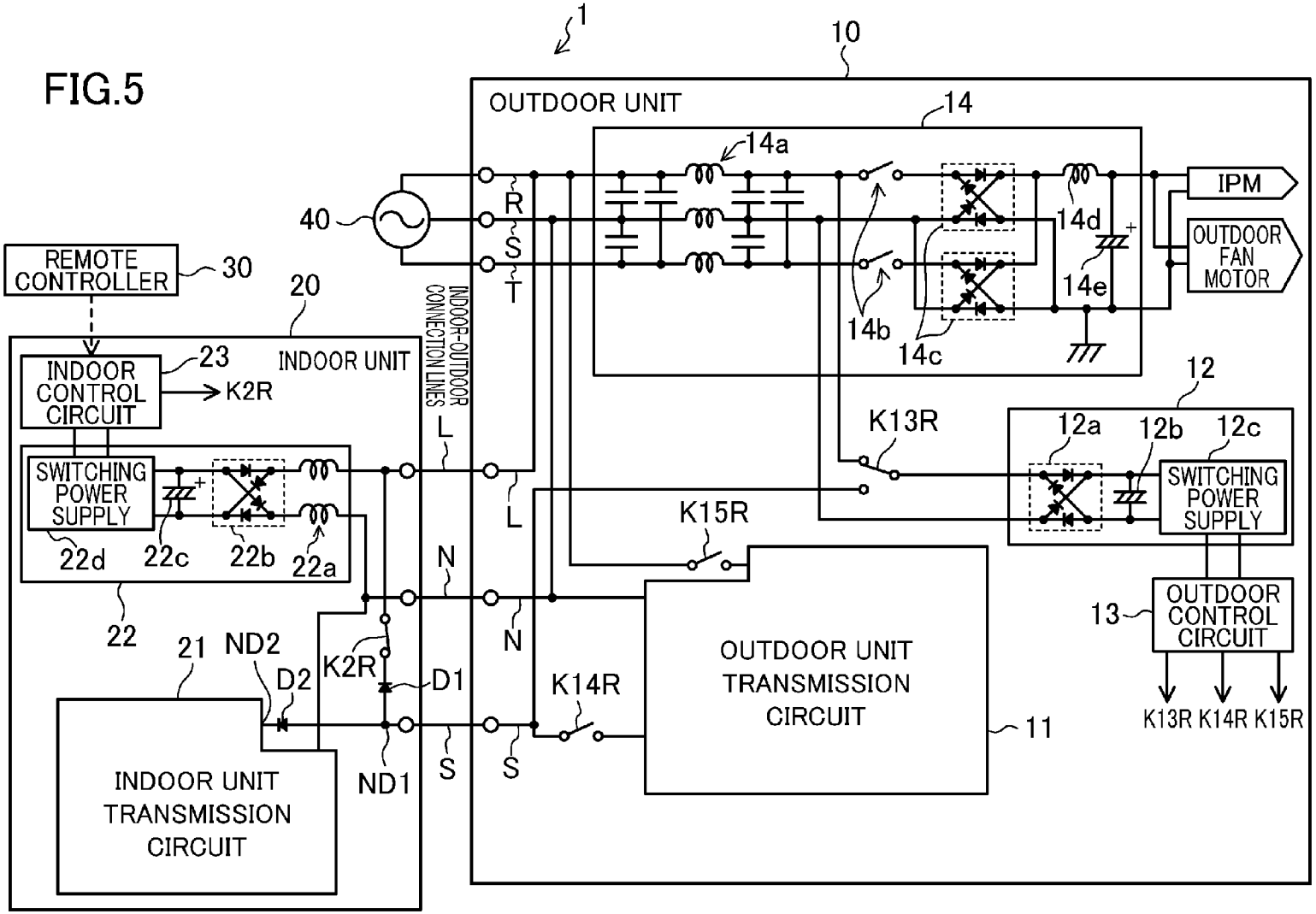
FIG. 5 illustrates states of the relays when transition to a charging state is completed.

First, a state of the electrical system in the suspended state will be described. FIG. 1 illustrates states of the relays in the suspended state. In the suspended state, in the outdoor unit (10), no electric power is supplied to the coil of the main relays (14*b*), and no power is supplied from the first outdoor power supply circuit (14) to any of the intelligent power module and the outdoor fan motor. As also shown in FIG. 3, in the outdoor unit (10), no electric power is supplied to the coils of the other relays (K13R, K14R, K15R), either. Thus, the relay (K14R) and the relay (K15R) are off. That is, the outdoor unit transmission circuit (11) and the signal line (S) are disconnected from each other, and supply of power is shut off The relay (K13R) is switched to a state in which the normally closed contact is connected to the movable contact (is turned off). That is, one of the inputs of the diode bridge circuit (12*a*) of the second outdoor power supply circuit (12) is connected to the signal line (S). In this state, no current is supplied to the second outdoor power supply circuit (12), and the outdoor control circuit (13) is not supplied with power. In this manner, in the suspended state, standby power consumption of the outdoor unit (10) can be eliminated. FIG. 3 does not show the relay (K15R).

As also shown in FIG. 3, in the indoor unit (20) in the suspended state, no electric power is supplied to the coil of the relay (K2R), and the relay (K2R) is in the off state. That is, the signal line (S) is not electrically connected to the power line (L). As described above, in the indoor unit (20), a portion of the indoor control circuit (23) responsible for signal reception from the remote controller (30) operates while being supplied with power from the indoor power supply circuit (22).

<Transition from Suspended State to Charging State>

As illustrated in FIG. 3, in the suspended state, when a user turns on an operation button of the remote controller (30) and instructs an operation start (e.g., a start of cooling operation) of the air conditioner (1), for example, the indoor control circuit (23) turns the relay (K2R) on after a lapse of a predetermined time. Then, in the air conditioner (1), a power transmission path (which will be hereinafter referred to as a power transmission path at start for convenience of description) from the R-phase of the three-phase AC to one of the inputs of the diode bridge circuit (12*a*) via the power line (L), the relay (K2R), the first diode (D1), the signal line (S), and the relay (K13R) is formed. The other input of the diode bridge circuit (12*a*) is connected to the S-phase of the three-phase AC, and thus, a single-phase AC subjected to half-wave rectification in the first diode (D1) is supplied to the diode bridge circuit (12*a*). That is, a circuit for charging the smoothing capacitor (12*b*) is formed (see FIG. 4).

At this time, in a situation where the potential of the R-phase of the three-phase AC is higher than the potential of the S-phase (i.e., an AC flows from the R-phase to the S-phase), the first diode (D1) inhibits an AC flowing from the power line (L) into the indoor unit transmission circuit (21) and the outdoor unit (10). The indoor unit transmission circuit (21) is connected to the R-phase through the indoor power supply circuit (22), but an AC flowing from the indoor unit transmission circuit (21) to the signal line (S) is inhibited by the second diode (D2).

In a situation where the potential of the S-phase of the three-phase AC is higher than the potential of the R-phase (i.e., an AC flows from the S-phase to the R-phase), current flows in the diode bridge circuit (12*a*). In this case, an end of the communication circuit in the indoor unit transmission circuit (21) is connected to the S-phase of the three-phase AC through the common line (N), and the other end of the communication circuit is connected to the S-phase of the three-phase AC through the signal line (S), the relay (K13R), and the diode bridge circuit (12*a*). That is, the indoor unit transmission circuit (21) is connected to only one phase of the three-phase AC. Thus, even when the signal line (S) is used for transmission of AC power, no AC current flows in the communication circuit in the indoor unit transmission circuit (21). In the foregoing manner, the outdoor unit transmission circuit (11) is protected against overvoltage.

As shown in FIG. 3, when the relay (K2R) turns on, the smoothing capacitor (12*b*) starts being changed, and an input voltage to the switching power supply (12*c*) gradually increases. Once the input voltage to the switching power supply (12*c*) has been stabilized, the switching power supply (12*c*) is allowed to output a specific DC voltage (5 V in this example). That is, the switching power supply (12*c*) is activated. In this manner, the outdoor control circuit (13) is started.

Next, after a lapse of a predetermined time t1 from the start of the outdoor control circuit (13), the outdoor control circuit (13) causes a current to flow in the relay (K13R), and switches the relay (K13R) to the on state in which the normally opened contact and the movable contact are connected to each other. In this manner, one of the inputs of the diode bridge circuit (12*a*) is connected to the R-phase of the three-phase AC through the power transmission path in the outdoor unit (10). That is, the outdoor control circuit (13) switches to a state in which power is supplied from the AC power supply (40) not passing through the signal line (S) (see FIG. 5). Then, transition to the charging state is completed in the air conditioner (1).

The outdoor control circuit (13) includes a timer (not shown), and the timer counts the predetermined time t1. That is, the timer of the outdoor control circuit (13) starts counting concurrently with the start of the outdoor control circuit (13). In this embodiment, the predetermined time t1 is determined in view of the following points. For example, in the case of switching the relay (K13R) to the on state concurrently with a start of the outdoor control circuit (13), the smoothing capacitor (12*b*) is not sufficiently charged, and thus, a voltage input from the smoothing capacitor (12*b*) to the switching power supply (12*c*) decreases at the switching of the relay (K13R). As a result, the switching power supply (12*c*) might stop in the worst case. In this embodiment, the relay (K13R) is not immediately switched after the start of the outdoor control circuit (13), and the is switched after the smoothing capacitor (12*b*) has been sufficiently charged. Thus, the predetermined time t1 is determined in consideration of a time necessary for sufficiently charging the smoothing capacitor (12*b*).

<Transition from Charging State to Wait State>

Figure 6:
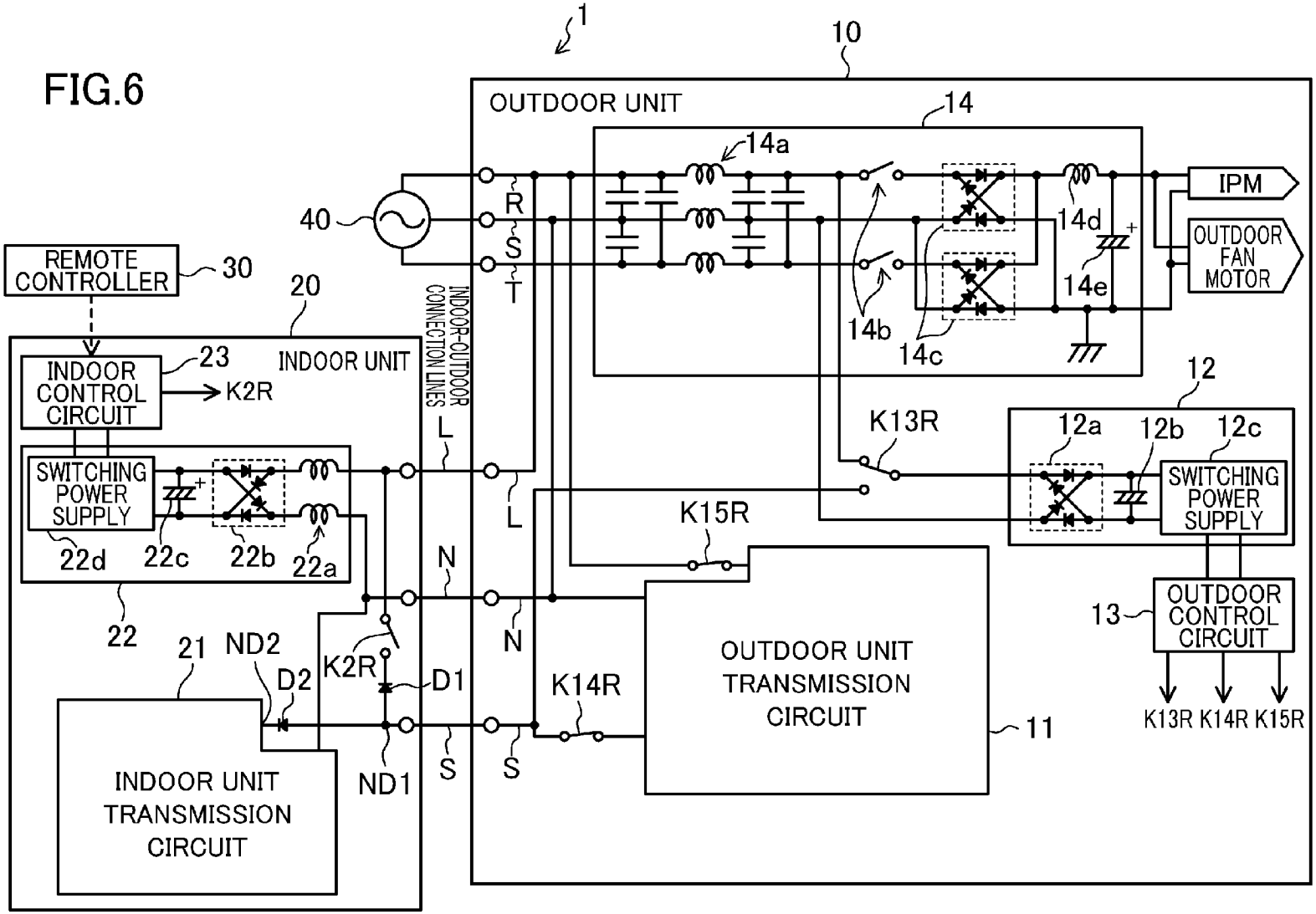
FIG. 6 illustrates states of the relays when transition to a wait state is completed.

As shown in FIG. 3, the indoor control circuit (23) switches the relay (K2R) to the off state after a lapse of a predetermined time t2 from switching of the relay (K2R) to the on state (see FIG. 6). In this manner, the signal line (S) can be used for signal transmission. The indoor control circuit (23) includes a timer (not shown), and the timer counts the predetermined time t2. In this embodiment, the predetermined time t2 is determined such that a time sufficient for the start of the outdoor control circuit (13) is obtained and the outdoor control circuit (13) is started after switching of the relay (K13R) to the on state.

Then, in the outdoor unit (10), after a lapse of a predetermined time t3 from the start of the outdoor control circuit (13), the outdoor control circuit (13) switches the relay (K15R) to the on state so that power is supplied to the outdoor unit transmission circuit (11), and also switches the relay (K14R) to the on state. Then, the communication circuit in the outdoor unit transmission circuit (11) is connected to the indoor unit transmission circuit (21) through the signal line (S) and the common line (N) (see FIG. 6). In this manner, the indoor unit transmission circuit (21) becomes able to perform signal transmission with the outdoor unit transmission circuit (11).

The predetermined time t3 is counted by the timer of the outdoor control circuit (13). The predetermined time t3 is determined such that the relay (K14R) is switched to the on state after the relay (K2R) has been switched to the off state. When the relay (K14R) is switched to the on state with the relay (K2R) being in the on state, the communication circuit in the indoor unit transmission circuit (21) is connected to the S-phase of the three-phase AC through the signal line (S) and the power line (L). Then, an AC exceeding a rated current of the communication circuit in the indoor unit transmission circuit (21) flows in the communication circuit, and the communication circuit is damaged. On the other hand, in this embodiment, the relay (K14R) is switched to the on state without fail after the relay (K2R) has been switched to the off state, thereby ensuring protection of the indoor unit transmission circuit (21). That is, in this embodiment, after a lapse of a predetermined time from switching of the relay (K2R) to the off state, the relay (K14R) is switched to the on state.

After a lapse of a predetermined time t4 from the start of the outdoor control circuit (13), the outdoor unit transmission circuit (11) starts transmission to the indoor unit transmission circuit (21). The predetermined time t4 is also counted by the timer of the outdoor control circuit (13).

In the foregoing manner, the air conditioner (1) transitions to a state (i.e., the wait state) in which the air conditioner (1) is ready for transition to the operating state immediately through the charging state.

<Transition from Wait State to Operating State>

Figure 7:
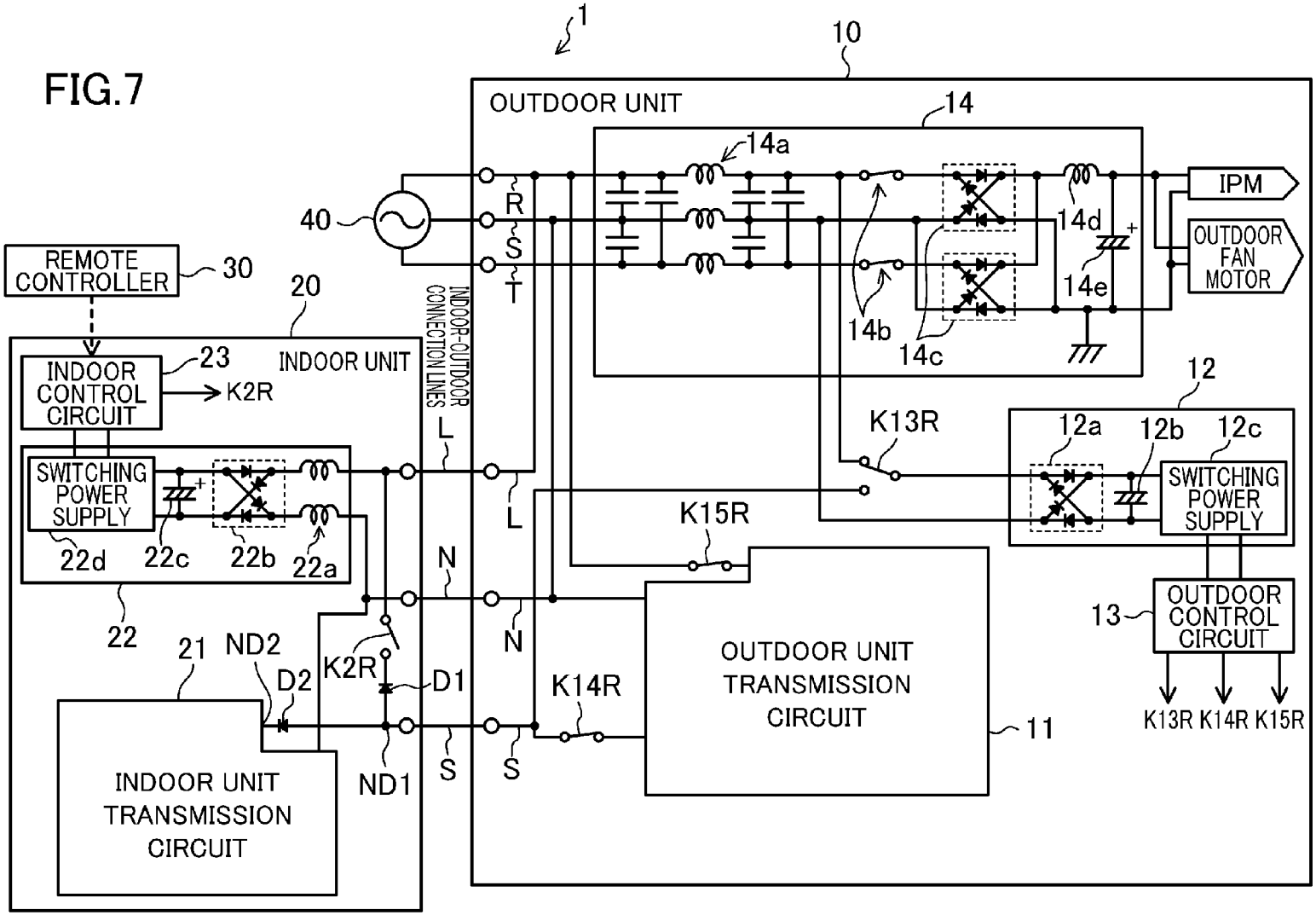
FIG. 7 illustrates states of the relays in an operating state.

As illustrated in FIG. 7, in transition from the wait state to the operating state, the outdoor control circuit (13) turns the two main relays (14*b*) on. Then, the first outdoor power supply circuit (14) supplies power to the intelligent power module and the outdoor fan motor, and the electric compressor, for example, comes to be in the operating state and performs, for example, cooling operation.

Advantages of Embodiment

As described above, in this embodiment, the relay (K2R) is switched to the on state so that the outdoor control circuit (13) starts, and then the relay (K13R) is switched to the on state so that power is supplied from the AC power supply (40) to the outdoor control circuit (13). In this manner, the outdoor unit (10) is started. In the suspended state, the relay (K2R) and the relay (K13R) are turned off, thereby shutting off the power supply from the AC power supply (40) to the outdoor control circuit (13). Then, standby power consumption of the outdoor unit (10) can be sufficiently reduced.

In addition, in this embodiment, the relay (K13R) is switched to the on state, and then the relay (K2R) is switched to the off state. Thus, it is possible to start the outdoor unit (10), while inhibiting a current flow from the AC power supply (40) to the signal line (S). That is, the configuration of this embodiment ensures transmission of a signal through the signal line (S) after the start of the outdoor unit (10).

Further, in this embodiment, the relay (K2R) is switched to the off state, and then the relay (K14R) is switched to the on state. Thus, an AC flow from the AC power supply (40) to the outdoor unit transmission circuit (11) through the signal line (S) can be inhibited. Thus, at the start of the outdoor unit (10), the outdoor unit transmission circuit (11) can be protected.

In particular, since the relay (K14R) is switched to the on state after a lapse of a predetermined time from switching of the relay (K2R) to the off state, it is possible to ensure inhibition of an AC flowing from the AC power supply (40) to the communication circuit of the outdoor unit transmission circuit (11). As a result, it is possible to ensure protection of the outdoor unit transmission circuit (11) at the start of the outdoor unit (10).

Other Embodiments

In the above embodiment, the relay (K2R) is an A-contact relay, but may be a C-contact relay. In this case, the C-contact relay is configured such that the indoor unit (20) switches between an on state in which the signal line (S) is connected to the power line (L) and an off state in which the signal line (S) is connected to the indoor unit transmission circuit (21). In this case, the two diodes (D1, D2) are unnecessary.

In the above embodiment, the relay (K2R) may be replaced by a semiconductor switch (e.g., a transistor).

The AC power supply (40) may supply a single-phase AC.

INDUSTRIAL APPLICABILITY

The present invention is useful for air conditioners.

DESCRIPTION OF REFERENCE CHARACTERS

1 air conditioner
10 outdoor unit
11 outdoor unit transmission circuit
13 outdoor control circuit
20 indoor unit
21 indoor unit transmission circuit
23 indoor control circuit
40 AC power supply
K2R relay (first switch)
K13R relay (second switch)
K14R relay (third switch)
L power line
N common line
S signal line

The invention claimed is:

1. An air conditioner in which a power line for transmission of AC power from an AC power supply, a signal line for signal transmission, and a common line to be shared by the transmission of AC power and the signal transmission are connected to one another between an outdoor unit and an indoor unit, wherein the indoor unit includes an indoor control circuit and a first switch that is switched by the indoor control circuit between an on state in which the first switch connects the signal line and the power line to each other and an off state in which the first switch disconnects the signal line and the power line from each other, the outdoor unit includes an outdoor control circuit and a second switch that is switched by the outdoor control circuit between an on state in which the second switch connects the outdoor control circuit to the AC power supply and an off state in which the second switch connects the outdoor control circuit to the signal line, and the indoor control circuit switches the first switch to the on state with the second switch being in the off state, and when the outdoor control circuit starts, the outdoor control circuit switches the second switch to the on state, then the indoor control circuit switches the first switch to the off state, and starts the outdoor unit.

2. The air conditioner of claim 1, wherein the indoor unit includes an indoor unit transmission circuit, the outdoor unit includes an outdoor unit transmission circuit that performs signal transmission with the indoor unit transmission circuit through the signal line, and a third switch that switches between an on state in which the third switch connects the outdoor unit transmission circuit and the signal line to each other and an off state in which the third switch disconnects the outdoor unit transmission circuit and the signal line from each other, and in starting the outdoor unit, the outdoor control circuit switches the third switch to the on state after the first switch has been switched to the off state.

3. The air conditioner of claim 2, wherein in starting the outdoor unit, the outdoor control circuit switches the third switch to the on state after a lapse of a predetermined time from switching of the first switch to the off state.

* * * * *